US005459882A

United States Patent [19]

Yamamoto

[11] Patent Number: 5,459,882

[45] Date of Patent: Oct. 24, 1995

[54] SWIMMING GOGGLES

[75] Inventor: Tamenobu Yamamoto, Higashi-Osaka, Japan

[73] Assignee: Yamamoto Kogaku Co., Ltd., Higashi-Osaka, Japan

[21] Appl. No.: 300,032

[22] Filed: Sep. 2, 1994

[30] Foreign Application Priority Data

Sep. 6, 1993 [JP] Japan ..... 5-221420

[51] Int. Cl.[6] ..... A61F 9/02

[52] U.S. Cl. ..... 2/428; 2/445; 2/452

[58] Field of Search ..... 2/428, 430, 445, 2/452, 447; 351/126, 128, 133

[56] References Cited

U.S. PATENT DOCUMENTS

| | | | |
|---|---|---|---|
| 2,194,401 | 3/1940 | Malcom | 2/445 |
| 2,195,175 | 3/1940 | Kimball | 2/445 |
| 2,804,623 | 9/1957 | Hirschmann | 2/445 |
| 4,264,987 | 5/1981 | Runckel . | |
| 4,468,819 | 9/1984 | Ohno | 2/430 |
| 4,930,885 | 6/1990 | Laschober | 2/452 X |

FOREIGN PATENT DOCUMENTS

| | | |
|---|---|---|
| 64-4372 | 2/1989 | Japan . |
| 2-28939 | 8/1990 | Japan . |

*Primary Examiner*—Peter Nerbun

*Attorney, Agent, or Firm*—Oblon, Spivak, McClelland, Maier & Neustadt

[57] ABSTRACT

Swimming goggle comprises a right eyepiece, a left eyepiece, a flexible connecting strap having opposite ends detachably connected to the respective inner ends of the right and the left eyepiece to interconnect the right and the left eyepiece so that the effective length thereof corresponding to the distance between the right and the left eyepiece is adjustable, and each provided with a plurality of engaging portions, and an elastic band having opposite ends connected to band buckles capable of being detachably connected to the respective outer ends of the right and the left eyepiece, respectively. Each of the right and the left eyepiece is provided integrally with an inwardly extending, rectangular connecting frame having an aperture for receiving one end of the connecting strap therethrough and a catching portion that engages one of the plurality of engaging portions of the connecting strap, and an elastically bendable holding tongue for preventing the engaging portion of the connecting strap engaging the catching portion of the connecting frame from being disengaged from the catching portion of the connecting frame projects toward the front from the inner end of each eyepiece into the aperture of the connecting frame so as to form a space through which the connecting strap extends.

4 Claims, 6 Drawing Sheets

SWIMMING GOGGLES

FIELD OF THE INVENTION AND RELATED STATEMENT

The present invention relates to swimming goggles.

Goggles for recreational swimming and competitive swimming have, as principal components, a pair of eyepieces respectively provided with lenses, a connecting strap interconnecting the eyepieces, and an elastic band. It is difficult to choose a pair of goggles that fit the head of a user or suit the taste of the user among many pairs of goggles which are difficult to disassemble. Recently developed goggles such as disclosed in, for example, Japanese Utility Model Publication Nos. Sho 64-4372 (cited reference 1) and Hei 2-28939 (cited reference 2) can be completed by assembling desired parts including a pair of eyepieces, a connecting strap and an elastic band.

The goggles of the cited reference 1 are provided with a replaceable elastic band the length of which is easily adjustable. Each of the right and the left eyepiece is provided with a hollow in its outer end, a vertical shaft placed in the hollow, and a band fixture having an elastic hook portion to be detachably attached to the vertical shaft so as to be turnable about the axis of the vertical shaft and a buckling portion for buckling the elastic band so that the length of the elastic band is adjustable and is detachably attached to the vertical shaft. The hollows formed in the right and the left eyepiece must be covered with covers to eliminate the hydraulic resistance of the hollows against the flow of water relative to the goggles, which, however, increases the number of parts necessary for constructing the goggles and makes assembling and disassembling the goggles troublesome.

The goggles of the cited reference 2 have a connector provided with a plurality of teeth inclined toward the center and placed with its opposite ends projecting outward, fixed connecting seats for supporting the connector, and bendable connecting seats formed of a flexible resin to lock and make the length of the connector adjustable. The bendable connecting seat can be bent in opposite directions on its bend so as to engage the plurality of teeth. There is the possibility, if a comparatively high transverse pulling force acts through the teeth of the connector on the bendable connecting seats, that the bendable connecting seats are bent in the direction of action of the pulling force and, eventually, the connector is suddenly disengaged from the bendable connecting seats.

OBJECT AND SUMMARY OF THE INVENTION

Accordingly, it is an object of the present invention to provide goggles that can be assembled from a pair of eyepieces, a connecting strap interconnecting the eyepieces, and an elastic band so that those parts are firmly joined together and can readily be disassembled into those parts for intentional disassembling.

Goggles of the present invention comprising a right eyepiece, a left eyepiece, a flexible connecting strap having opposite ends detachably connected to the respective inner ends of the right and the left eyepiece so that its effective length corresponding to the distance between the right and the left eyepiece is adjustable, and an elastic band having opposite ends connected to buckling means detachably connected to the outer ends of the right and the left eyepiece, respectively, incorporates the following technical improvements.

In a first technical improvement incorporated into the present invention, the right and the left eyepiece are integrally provided at their inner ends with transversely projecting rectangular connecting frames having apertures to receive the opposite ends of a connecting strap having engaging portions, and catching portions each for catching one of the engaging portions of the connecting strap and releasing the same engaging portion, and elastically bendable holding tongues projecting toward the front from the respective inner ends of the right and the left eyepiece into the apertures of the connecting frames, respectively, so as to be bent elastically outward when changing the engaging portions of the connecting strap in engagement with the catching portions.

In a second technical improvement incorporated into the present invention, each of the right and the left eyepiece is provided at its outer end with a receiving seat rising substantially perpendicularly to the surface of the lens of the corresponding eyepiece, a supporting seat formed integrally with the base of the receiving seat and extending outward and substantially perpendicularly to the receiving seat, and a pair of detaining protrusions having detaining ridges substantially parallel to the receiving seat, and a catching portion each formed between the pair of detaining protrusions on the receiving seat; and band buckling means connected to the opposite ends of an elastic band, respectively, and each having a contact wall having an elastically bendable locking finger directly facing the receiving seat and provided with an engaging portion capable of being detachably mated with the catching portion, and stopper lugs capable of detachably engaging the detaining protrusions to prevent the band buckling means from separating from the supporting seat longitudinally of the band.

The first and the second improvements may be employed in combination. The right and the left eyepiece may be provided integrally with lenses, respectively.

When the right and the left eyepiece of the goggles are put to the head of the user and held against the head by an elastic band, a transverse pulling force acts on the connecting strap. Since the engaging portions of the connecting strap are in engagement with the locking portions of the connecting frames, and the connecting frames have a rectangular shape, the locking portions are not bent and the connecting strap will not accidentally be disengaged from the locking portions. The holding protrusions surely prevent the engaging portions from escaping from the locking portions by preventing the opposite ends of the connecting strap from bending toward the front. Since the detaining protrusions and the catching portions are formed on the receiving seats and the supporting seats, respectively, and the engaging portions and the stopper lugs of the band buckling means are in elastic engagement with the detaining protrusions and the catching portions of the receiving seats and the supporting seats, the elastic band is firmly connected to the eyepieces and will not accidentally be disconnected from the eyepieces. When it is desired to adjust the distance between the right and the left eyepiece or to replace either the right or the left eyepiece with another eyepiece provided with a lens having a different diopter, the holding tongues holding the connecting strap in place are elastically bent outward so that the engaging portions of the connecting strap are released from the catching portions. The elastic band can easily be disconnected from the eyepieces simply by prying the same.

Thus the goggles of the present invention can be disassembled into the right eyepiece, the left eyepiece, the connecting strap for interconnecting the right and the left eyepiece and the elastic band. Therefore goggles provided with eyepieces having lenses having diopters suitable for the user can be constructed, and the distance between the right and the left eyepiece can easily be adjusted to a distance fitting to the user. The holding tongues hold surely the connecting strap interconnecting the right and the left eyepiece in place, and the effective length of the connecting strap can readily be adjusted by pressing the opposite ends of the connecting strap outward against the holding tongues so that the holding tongues are elastically bent outward and the spaces between the holding tongues and the corresponding detaining protrusions are expanded. The opposite ends of the elastic band can be firmly connected to the outer ends of the eyepieces, respectively, by attaching the band buckling means to the eyepieces by a single action, and the band buckling means do not increase resistance against the flow of water relative to the goggles.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Figure 1:
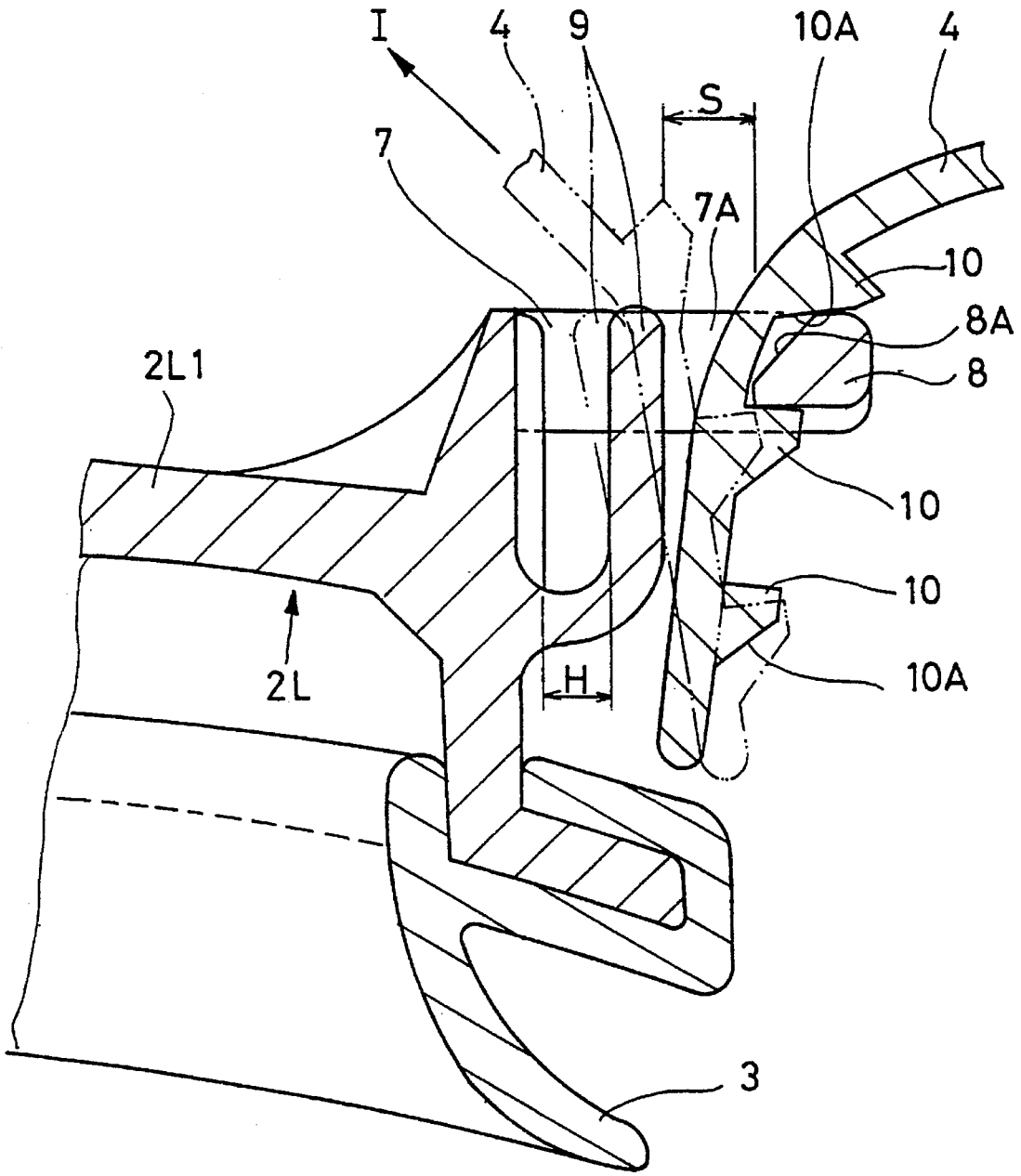
FIG. 1 is a sectional view of an essential portion of goggles in a preferred embodiment according to the present invention.
Figure 2:
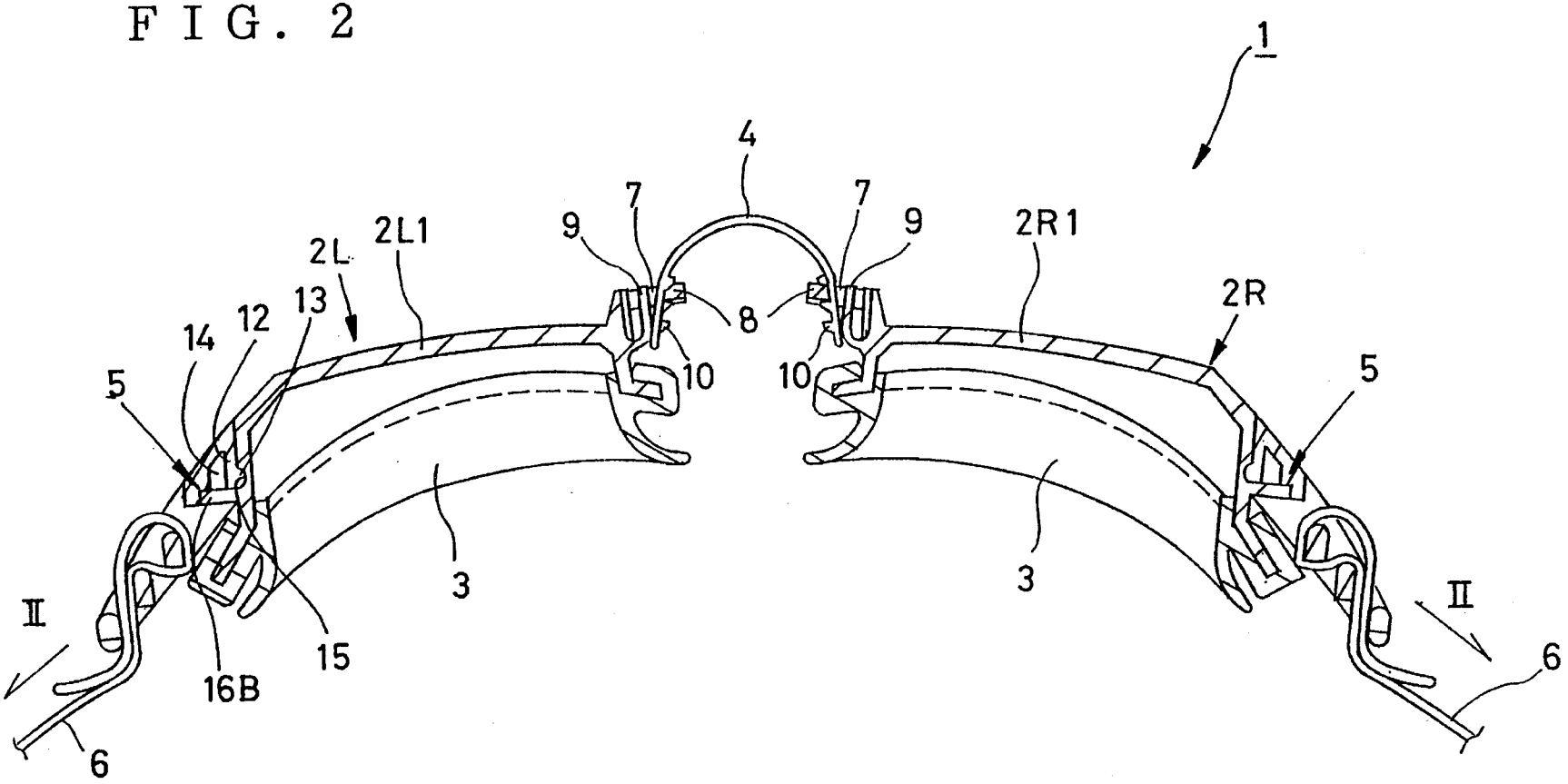
FIG. 2 is a sectional view of the goggles having the portion shown in FIG. 1.

Referring to FIGS. 1 to 5 showing goggles 1 in a first embodiment according to the present invention, the goggles 1 comprise a right eyepiece 2R, a left eyepiece 2L, a flexible connecting strap 4 having opposite ends detachably connected to the respective inner ends of the eyepieces 2R and 2L to interconnect the eyepieces 2R and 2L so that the distance between the eyepieces 2R and 2L is adjustable, and an elastic band 6 having opposite ends connected to band buckles 5 detachably connected to the respective outer ends of the eyepieces 2R and 2L, respectively. Soft, elastic, annular pads 3 are removably attached to the contact contours of the eyepieces 2R and 2L so that the eyepieces 2R and 2L are in soft contact with the face of the user and to insure watertight seal. The eyepieces 2R and 2L are formed of a transparent or semitransparent, hard synthetic resin, and at least the surfaces of the lenses are treated by a mist-proof process. Each of the eyepieces 2R and 2L is integrally provided with a rectangular connecting frame 7 having an aperture 7A to receive one end of the connecting strap 4. The connecting frames 7 are projected toward the front and are extended transversely from the respective inner ends of the eyepieces 2R and 2L, respectively. The extremities of the connecting frames 7 serve as catching portions 8.

The lenses of the eyepieces 2R and 2L may be either plane lenses or optical lenses. Although it is desirable to form the lenses integrally with the eyepieces 2R and 2L, the lenses may be formed separately and fitted in the frames of the eyepieces 2R and 2L.

Holding tongues 9 are formed integrally with the eyepieces 2R and 2L at the inner ends of the eyepieces 2R and 2L. The holding tongues 9 extend toward the front into the apertures 7A of the connecting frames 7 so as to form a fixed space S between the holding tongues 9 and the corresponding catching portions 8 and to form a fixed space H between the holding tongues 9 and the corresponding inner ends of the eyepieces 2R and 2L. Therefore, each holding tongue 9 is able to be bent elastically transversely as indicated by alternate long and two short dashes lines in FIG. 1. The flexible connecting strap 4 is formed of a synthetic resin or rubber. Each of the opposite ends of the connecting strap 4 is provided with three teeth 10 longitudinally arranged at fixed intervals. The thickness of portions having the teeth 10 of the connecting strap 4 is greater than the thickness of the space S between the catching portion 8 and the holding tongue 9. When each end of the connecting strap 4 is inserted into the space S between the catching portion 8 and the holding tongue 9 of either of the eyepieces 2R and 2L, the catching portion 8 engages one of the teeth 10 and the holding tongue restrains the tooth 10 from disengaging from the catching portion 9, so that the connecting strap 4 is unable to slip out of the space S. Each catching portion 8 has a sloping front surface 8A, and the front surface 10A of each of the teeth 10 that slides along the sloping front surface 8A of the catching portion 8 is inclined backward so that the tooth 10 can forcibly inserted into the space S, bending the holding tongue 9 outward. When pulling out the connecting strap 4 from the space S, the connecting strap 4 is pressed against the holding tongue so that the holding tongue 9 is bent outward and the space S between the catching portion 8 and the holding tongue 9 is expanded. Then, the tooth 10 is disengaged from the catching portion 8 to enable the connecting strap 4 to be pulled out of the space S. Practically, the connecting strap 4 is pulled obliquely outward relative to the eyepiece 2R or 2L in the direction of the arrow I (FIG. 1). Then, the holding tongue 9 is bent elastically outward as indicated by alternate long and two short dashes lines in FIG. 1, the tooth 10 is disengaged from the catching portion 8 and thereby the connecting strap 4 is allowed to slip out of the space S.

In a state where the goggles 1 are put on the head of the user, the connecting strap 4 pulls the eyepieces 2R and 2L away from each other, so that the teeth 10 of the connecting strap 4 engage the catching portions 8 of the eyepieces 2R and 2L firmly, and the holding tongues 10 prevents the teeth 10 from being disengaged from the corresponding catching portions 8. Since the catching portions 8 are formed integrally with the eyepieces 2R and 2L and have a sufficient strength, the catching portions 8 are rarely broken and the connecting strap 4 will not accidentally be disengaged from the eyepieces 2R and 2L.

Figure 3:
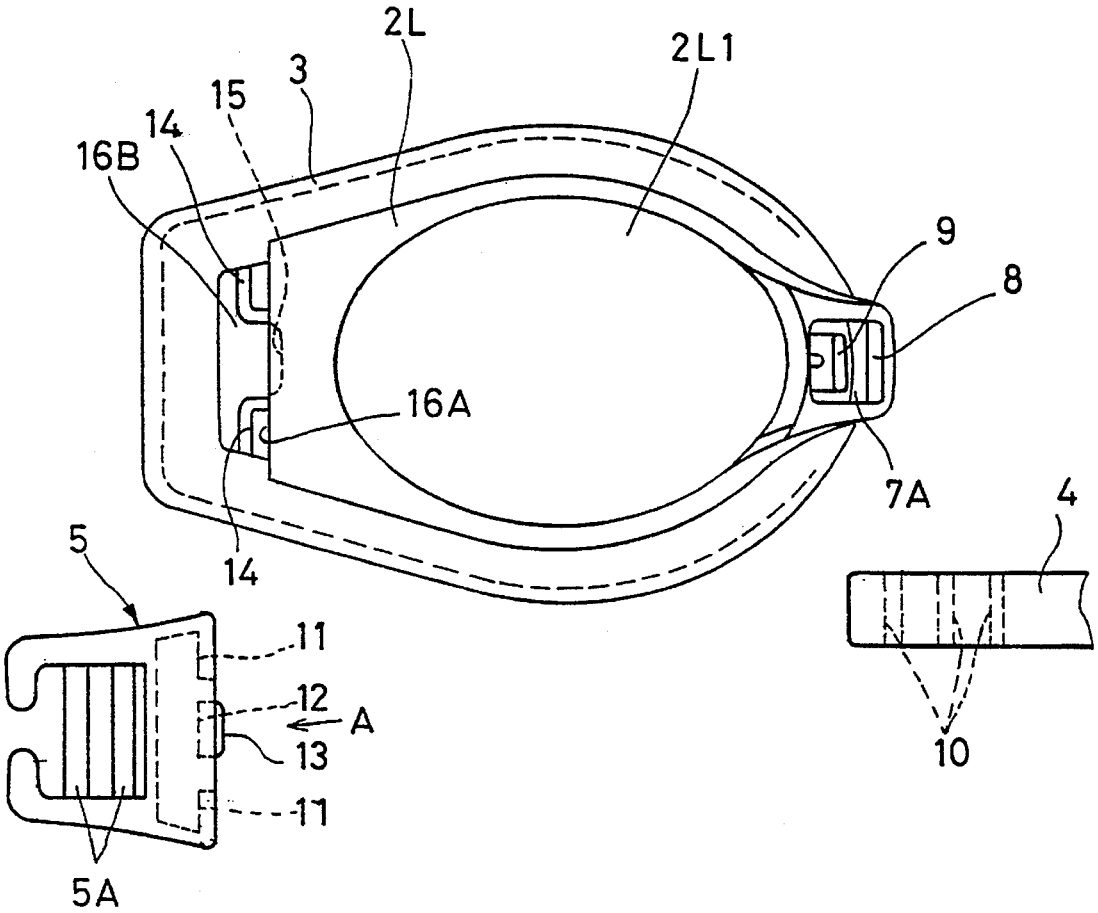
FIG. 3 is an exploded front view of the goggles of FIG. 2.
Figure 5:
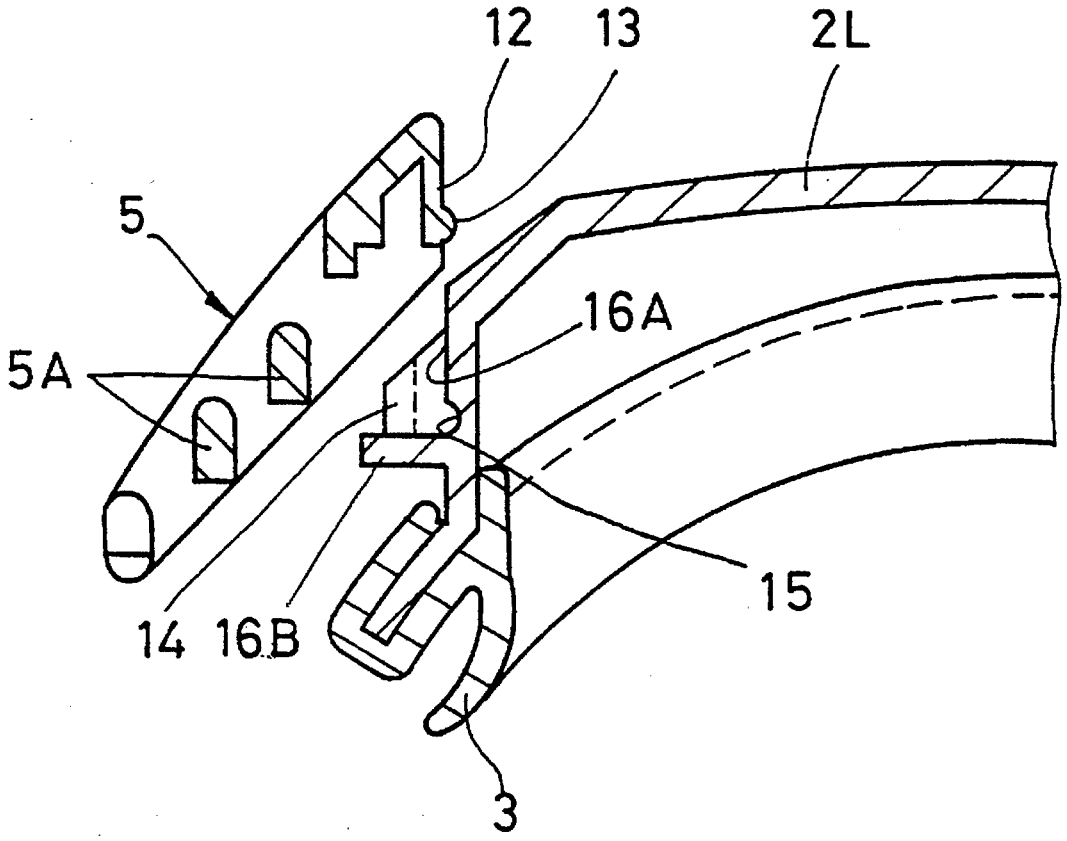
FIG. 5 is an exploded sectional view of a band fixture attaching structure included in the goggles of FIG. 2.

Referring to FIG. 5, each of the outer ends of the eyepieces 2R and 2L is provided with a receiving seat 16A extending substantially perpendicularly to the surface of the lens, a supporting seat 16B outwardly extending from the base end of the receiving seat 16A substantially perpendicularly to the receiving seat 16A, and a pair of L-shaped detaining protrusions 14 (FIG. 3). A catching recess 15 is formed in the base portion of the receiving seat 16A at a position between the pair of detaining protrusions 14.

Figure 4:
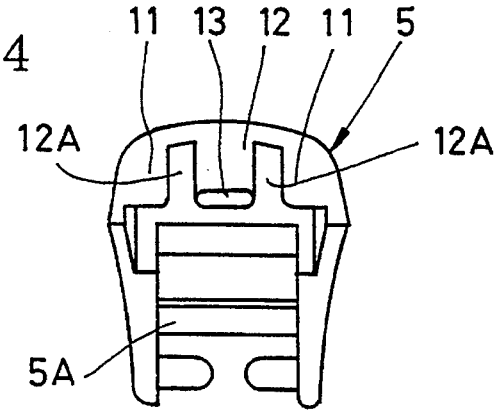
FIG. 4 is a band fixture of the goggles of FIG. 2 taken along the direction of the arrow A in FIG. 3.

Referring to FIGS. 3 to 5, the band buckle 5 formed of a hard synthetic resin has buckling bars 5A around which one end of the elastic band 6 is wound, and a contact wall 12 having an elastically bendable locking finger 13 to be detachably mated with the catching recess 15, recesses 12A for receiving The detaining protrusions 14, and stopper lugs 11 that engage the detaining protrusions 14 elastically and detachably to prevent the band buckle 5 from separating from the detaining protrusions 14 and the supporting seat 16B longitudinally of the band. When the band buckle 5 is attached from the front to either of the eyepieces 2R and 2L, the stopper lugs 11 are disposed on the upper and the lower side of the detaining protrusions 14, respectively, to prevent the band buckle 5 from moving transversely and vertically, and the locking finger 13 and the catching recess 15 are mated elastically to prevent the band buckle 5 from being separated toward the front from the eyepiece 2R or 2L. The detaining protrusions 14 are interposed between the contact wall 12 and the stopper lugs 11, so that the band buckle 5 is unable to come off vertically from the eyepiece 2R or 2L.

When disconnecting the elastic band 6 from the eyepieces 2R and 2L to replace the eyepieces 2R and 2L with other eyepieces provided with lenses having diopters different from those of the lenses of the eyepieces 2R and 2L, the band buckles 5 can very easily be disconnected from the eyepieces 2R and 2L, because each band buckle 5 is restrained from separation toward the front from the corresponding eyepiece 2R or 2L only by the engagement of the locking finger 13 and the catching recess 15. On the other hand, a pulling force acts on each band buckle 5 in the direction of the arrow II (FIG. 2) when the goggles 1 are put on the head of the user. However, the band buckles 5 are connected firmly to the eyepieces 2R and 2L by the firm engagement of the stopper lugs 11 and the detaining protrusions 14. Since the band buckles 5 extend in a stream line as shown in FIG. 1, the band buckles 5 do not increase the resistance of the goggles 1 against the flow of water.

Figure 6A:
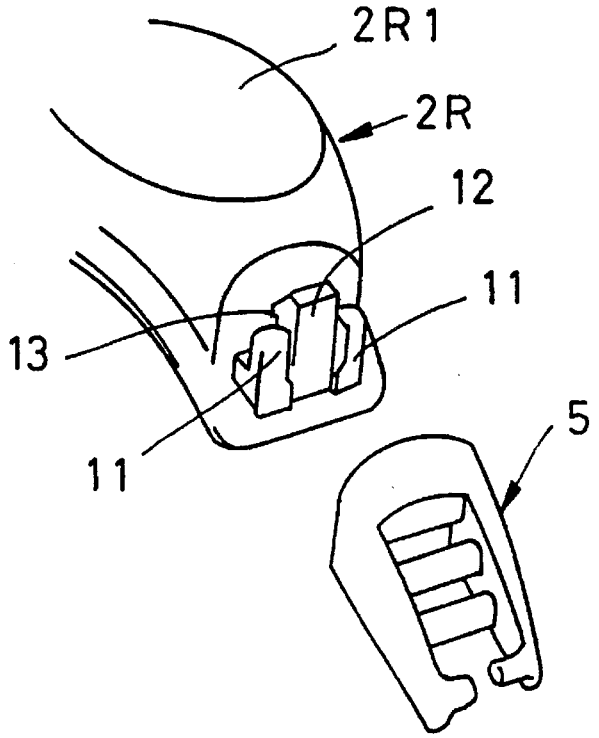
FIGS. 6(*a*) and 6(*b*) are a perspective view and an enlarged sectional view, respectively, of a modification of a band buckle included in the goggles of FIG. 2.
Figure 6B:
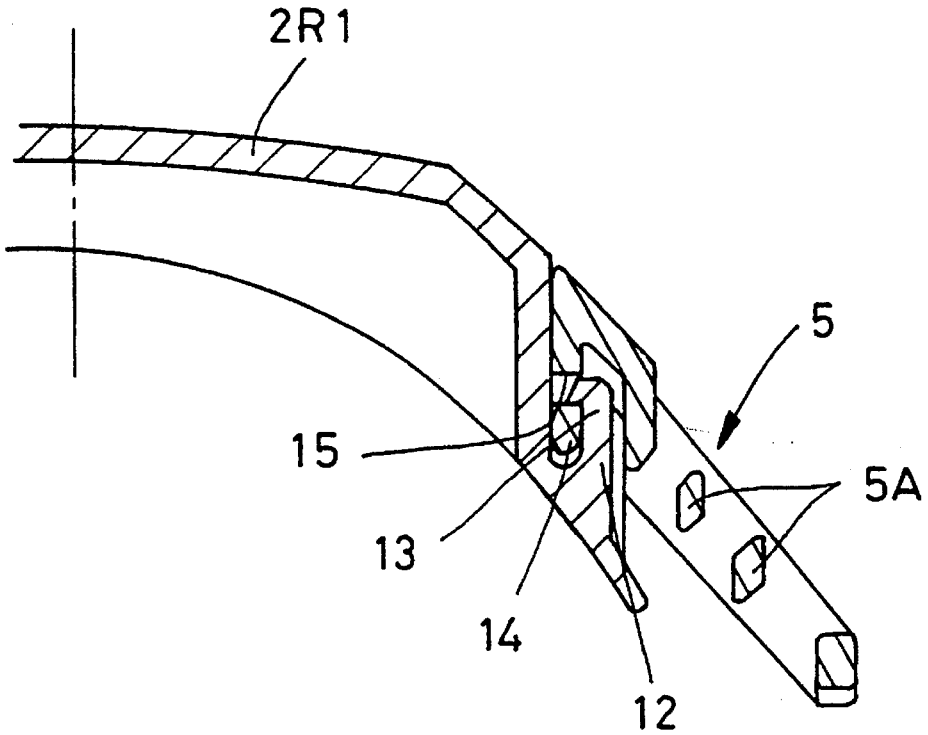

In another connecting structure for connecting the band buckle 5 to the eyepiece 2R or 2L shown in FIGS. 6(*a*) and 6(*b*), the detaining protrusions 14 and the catching recess 15 are formed on the band buckle 5, and the stopper lugs 11 and the contact wall 12 are formed on each of the eyepieces 2R and 2L.

The present invention is not limited in its application to the embodiments specifically described herein, and appropriate changes may be made in the design thereof.

Figure 7:
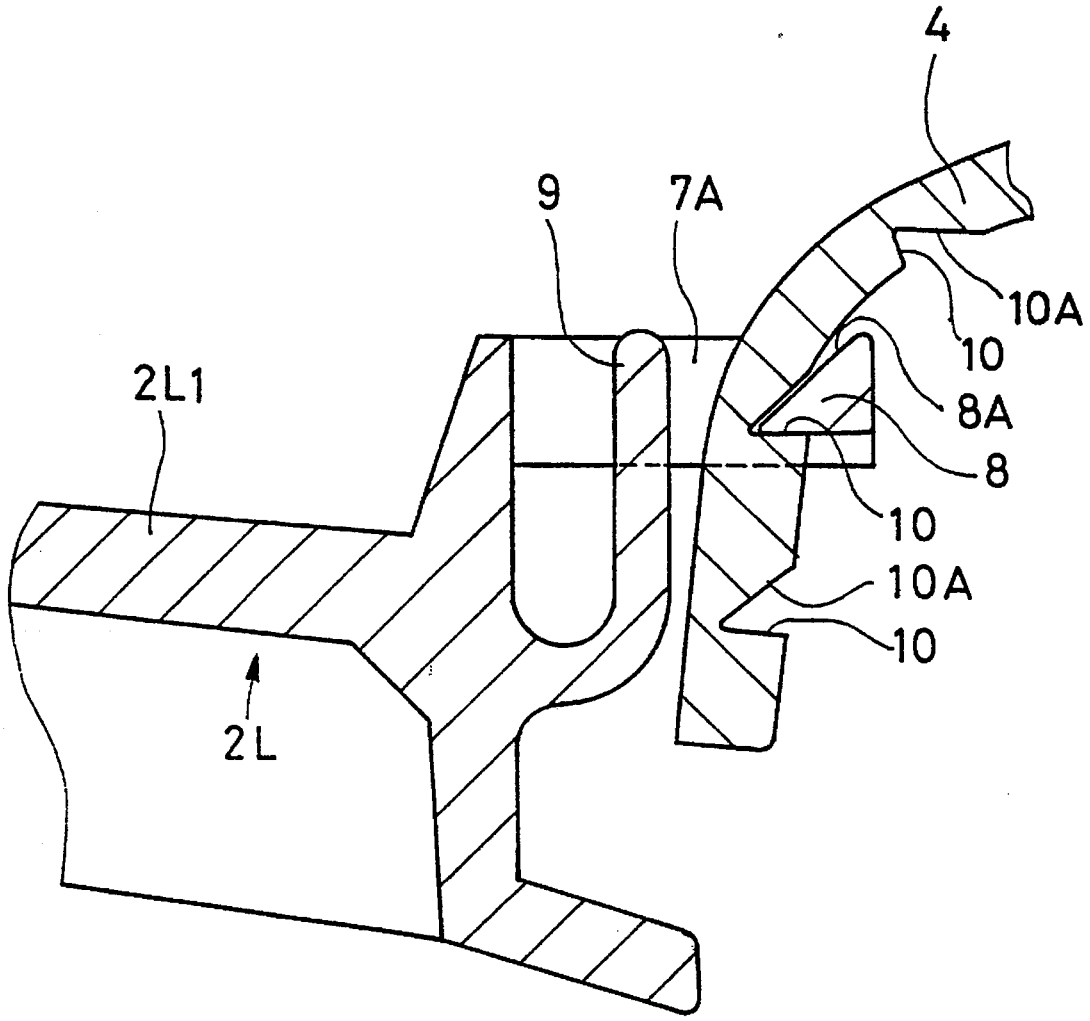
FIG. 7 is a sectional view of a modification of a connecting strap included in the goggles of FIG. 2.

For example, the holding tongue 9 may be an elastically bendable block of rubber or the like and may be attached to the eyepieces 2R and 2L. The connecting strap 4 may be provided with recesses 10 as shown in FIG. 7 instead of the teeth 10, and the catching portion 8 may be formed so as to engage the recess 10.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. Swimming goggles comprising: a right eyepiece; a left eyepiece; a flexible connecting strap having opposite ends detachably connected to respective inner ends of the right and left eyepieces to interconnect the right and the left eyepieces so that an effective length of the connecting strap which corresponds to a distance between the right and the left eyepieces is adjustable, the connecting strap being provided with a plurality of engaging portions in each end thereof; and an elastic band having opposite ends connected to band buckling means capable of being detachably connected to respective outer ends of the right and the left eyepieces, respectively; wherein:

each of the right and left eyepieces is provided at its inner end integrally with an inwardly extending, rectangular connecting frame having an aperture for receiving one end of the connecting strap therethrough and a catching portion that engages one of the plurality of engaging portions of the connecting strap; and an elastically bendable holding tongue for preventing the engaging portion of the connecting strap engaging the catching portion of the connecting frame from being disengaged from the catching portion of the connecting frame, said elastically bendable holding tongue forwardly projecting, with respect to a front surface of the right and left eyepieces, from the inner end of each of the right and left eyepieces into the aperture of the connecting frame so as to form a space that does not allow the engaging portion of the connecting strap engaging the catching portion of the connecting frame to be disengaged from the catching portion between the catching portion and a surface thereof facing the catching portion, said elastically bendable holding tongue being elastically bendable and can elastically be bent away from the catching portion of the connecting frame to allow the engaging portion of the connecting strap engaging the catching portion to be disengaged from the catching portion when disconnecting the connecting strap from the connecting frame or when bringing another engaging portion of the connecting strap into engagement with the catching portion.

2. Swimming goggles comprising: a right eyepiece; a left eyepiece; a flexible connecting strap having opposite ends connected to respective inner ends of the right and left eyepieces so that an effective length of the connecting strap which corresponds to a distance between the right and left eyepieces is adjustable; and an elastic band having opposite ends connected to band buckling means capable of being detachably connected to respective outer ends of the right and the left eyepieces, respectively, wherein:

each of the right and left eyepieces is provided at its outer end with a receiving seat rising substantially perpendicularly to a surface of a lens of the corresponding eyepiece, a supporting seat formed integrally with a base of the receiving seat and extending outwardly and substantially perpendicularly to the receiving seat, a pair of detaining protrusions having detaining ridges substantially parallel to the receiving seat, and a catching portion formed between the pair of detaining protrusions on the receiving seat; and each of the band buckling means connected to the opposite ends of an elastic band, respectively, has a contact wall having an elastically bendable locking finger directly facing the receiving seat and provided with an engaging portion capable of being detachably mated with the catching portion, and stopper lugs capable of detachably engaging the detaining protrusions to prevent the band buckling means from separating from the supporting seat longitudinally of the band.

3. Swimming goggles according to claim 2, wherein the contact wall is provided with recesses for detachably receiving portions of the pair of detaining protrusions.

4. Swimming goggles according to claim 1 or 2, wherein the right and the left eyepieces are provided integrally with lenses, respectively, and are formed of a hard synthetic resin by molding.

* * * * *